US006120019A

United States Patent [19]

Kayser et al.

[11] Patent Number: 6,120,019

[45] Date of Patent: Sep. 19, 2000

[54] CORRUGATED INPUT FEED FOR A BUCKLE ACCUMULATOR

[75] Inventors: David E. Kayser, Middlebury; Francesco Porco, Fairfield, both of Conn.

[73] Assignee: Pitney Bowes Inc., Stamford, Conn.

[21] Appl. No.: 09/163,650

[22] Filed: Sep. 30, 1998

[51] Int. Cl.[7] ..... B65H 29/68

[52] U.S. Cl. ..... 271/182; 271/188

[58] Field of Search ..... 271/182, 188

[56] References Cited

U.S. PATENT DOCUMENTS

| | | | |
|---|---|---|---|
| 4,346,880 | 8/1982 | Roller et al. | 271/186 |
| 4,350,332 | 9/1982 | Knight | 271/188 |
| 5,153,663 | 10/1992 | Bober et al. | 271/188 X |
| 5,246,224 | 9/1993 | Matsuno et al. | 271/188 X |
| 5,280,901 | 1/1994 | Smith et al. | 271/188 |
| 5,356,263 | 10/1994 | Miller | 414/790.7 |
| 5,358,231 | 10/1994 | Andela | 271/176 X |
| 5,543,909 | 8/1996 | Quesel | 271/228 X |
| 5,555,083 | 9/1996 | Kuo et al. | 271/188 X |
| 5,596,399 | 1/1997 | Dempsey et al. | 271/245 X |
| 5,609,334 | 3/1997 | Silveira et al. | 271/188 |
| 5,775,690 | 7/1998 | Quesnel et al. | 271/242 |
| 5,787,330 | 7/1998 | Funato | 271/188 X |

FOREIGN PATENT DOCUMENTS

| | | | |
|---|---|---|---|
| 295359 | 1/1988 | Japan | 271/188 |
| 135614 | 5/1994 | Japan | 271/188 |

*Primary Examiner*—Christopher P. Ellis
*Assistant Examiner*—Richard Ridley
*Attorney, Agent, or Firm*—Angelo N. Chaclas; Michael E. Melton

[57] ABSTRACT

A buckle accumulator including an input feed system and for feeding a sheet in a path of travel and an output feed system located downstream in the path of travel from the input feed system. The sheet having a leading edge and a stiffness. The lead edge of the sheet is substantially unrestrained between the input feed system and the output feed system. The input feed system imparts a furrow within the sheet to increase the stiffness of the sheet between the input feed system and the output feed system so that the lead edge of the sheet substantially follows a desired path of travel and enters the output feed system.

8 Claims, 10 Drawing Sheets

CORRUGATED INPUT FEED FOR A BUCKLE ACCUMULATOR

CROSS REFERENCE TO RELATED APPLICATIONS

This patent application is related to concurrently filed U.S. patent application Code/Ser. No. 09/163,685 entitled BUCKLE ACCUMULATOR HAVING SELECTIVELY ACTIVATEABLE SHEET DEFLECTOR, the disclosure of which is specifically incorporated herein by reference.

FIELD OF THE INVENTION

This invention relates to sheet accumulators that collect a plurality of sheets to form a stack of sheets. More particularly, this invention is directed to an accumulator including an input set of rollers forming a first nip and an output set of rollers forming a second nip where the sheets are corrugated at the first nip.

BACKGROUND OF THE INVENTION

It is known to be desirable in the paper handling art to provide paper handling apparatus, such as: copiers, inserters, and the like, with mechanisms, known as accumulators, which accumulate a sequence of sheets being processed by the apparatus to form a stack, or accumulation, for further processing. For example, a sequence of sheets might be fed to a printer for printing of predetermined information, and the output of the printer fed to an accumulator where a predetermined number of sheets in the sequence would be accumulated, and the resulting accumulation passed on for further processing, such as folding and insertion into an envelope.

Referring to FIG. 1, an example of a buckle type prior art accumulator 10 as substantially taught by U.S. Pat. No. 5,356,263 is shown. The accumulator 10 includes a feed mechanism 20 including a pair of input rollers 22 and a pair of output rollers 24 for feeding a sheet SI along a first path until the sheet is deflected onto a second path. The feed mechanism 20 continues to drive the sheet SI along the second path until the leading edge LE reaches a selectively activatable accumulating stop 12 which halts the leading edge LE of the sheet S1. The input rollers 22 continue to drive the sheet S1 so that the sheet S1 buckles away from the first path in a direction defined by the deflection of the sheet S1. As the input rollers 22 continue to feed the sheet S1 a loop forms B1 and the sheet S1 unrolls into a receiving space 30, which may be no more than an open area provided in the accumulator, so that as the trailing edge TE of the sheet S1 clears the feeder mechanism 20, the trailing edge TE and a substantial portion of the sheet S1 are displaced into the receiving space 30 and away from the first path as defined by the nip of the input rollers 22. Thus, the sheet S1 may be followed by a next sheet S2 which similarly reaches the stop 12 causing a respective loop B2 to form resulting in the accumulation of the next sheet S2 with the first sheet S1.

Although such accumulators generally work well, some difficulties have been experienced. Generally, the need for a receiving space 30 so as to allow the buckle or loop to form does not lend itself to the placement of a guide in an area 50 of the receiving space 30 adjacent to the feed path located between the input rollers 22 and the output rollers 24. As a result, the lead edge LE of the sheet S1 is not controlled on both sides of the sheet S1 meaning that the sheet S1 must bridge the gap between the nip of the input rollers 22 and the nip of the output rollers 24. Therefore, the lead edge LE is susceptible to wandering off the feed path due to a variety of reasons, such as: paper curl, vibration, air turbulence, and the like. Thus, the likelihood of paper jams is increased because the lead edge LE of the sheet S1 may stall in the area 50 of the receiving space 30 and not properly reach the nip of the output rollers 24 resulting in reduced reliability of the accumulator. This is due to the fact that a portion of the sheet S1 extending out from the nip of the input rollers 22 is cantelevered (supported at only one end) until it reaches the nip of the output rollers 22. Contributing to this problem is a practical requirement that the nip of the input rollers 22 cannot be located too close to the nip of the output rollers 24 because adequate leeway must be provided to allow the loop B1 to form. As a result, the gap between the nip of the input rollers 22 and the nip of the output rollers 24 is greater than what one skilled in the art will normally employ in view of the fact that a guide cannot be placed in area 50.

Thus, there is a need for an improved buckle accumulator that reduces the likelihood of jams and increases overall reliability of the accumulator. More particularly, there is a need for a buckle accumulator that provides increased control of the lead edge of a sheet as it is fed from the input rollers to the output rollers.

SUMMARY OF THE INVENTION

The present invention provides a cost effective means for substantially addressing those problems identified in the prior art and improving the reliability of the buckle accumulator. In conventional fashion, this invention may be incorporated into a variety of sheet handling systems, such as: copiers, inserters and the like.

In accordance with the present invention, there is provided a buckle accumulator including an input feed system and for feeding a sheet in a path of travel and an output feed system located downstream in the path of travel from the input feed system. The sheet having a leading edge and a stiffness. The lead edge of the sheet is substantially unrestrained between the input feed system and the output feed system. The input feed system imparts a furrow within the sheet to increase the stiffness of the sheet between the input feed system and the output feed system so that the lead edge of the sheet substantially follows a desired path of travel and enters the output feed system.

In accordance with the present invention, there is also provided a method of accumulating sheets and a method of manufacturing a buckle accumulator.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
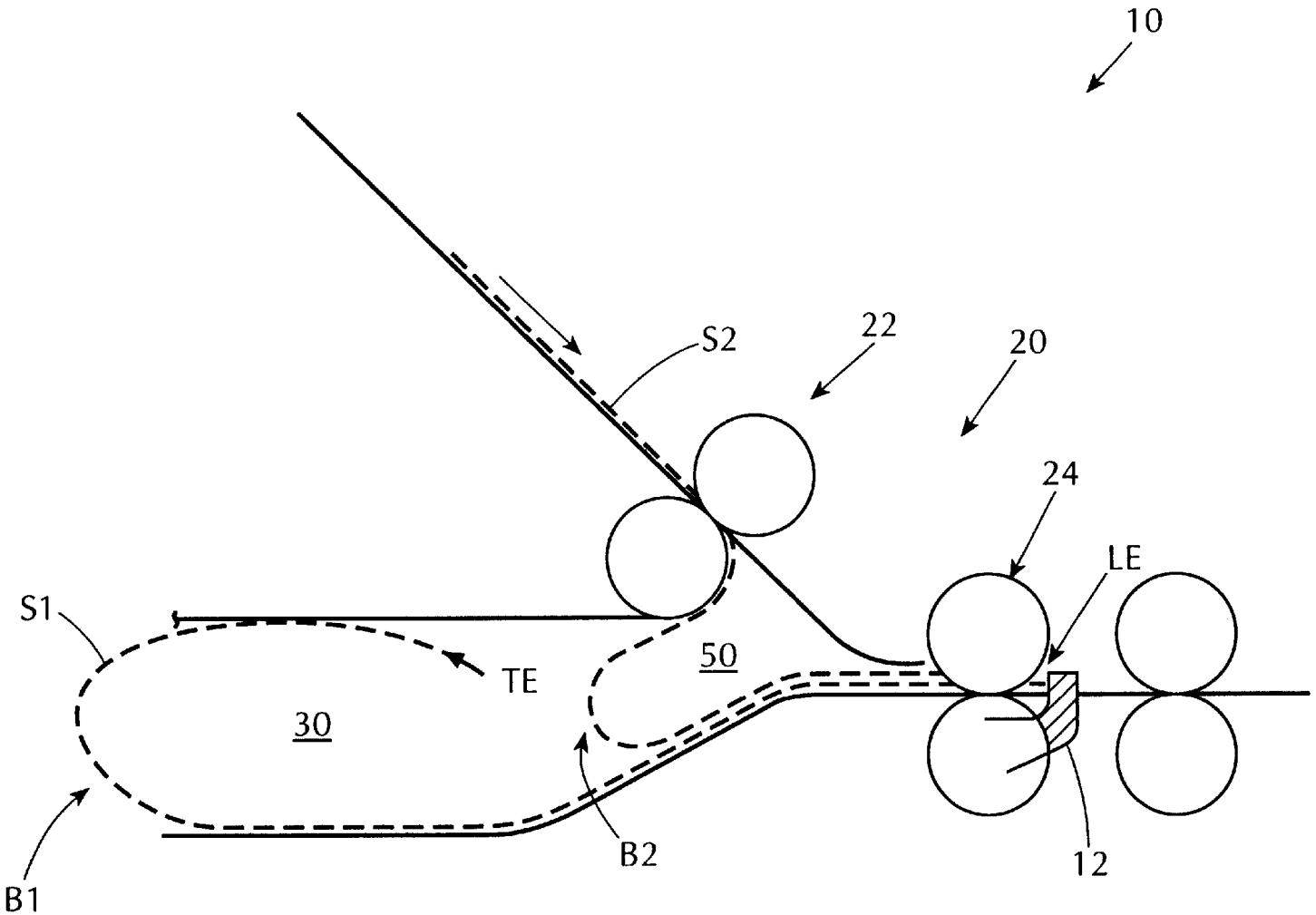
FIG. 1 PRIOR ART
FIG. 1 is a schematic representation of an elevational view of a prior art buckle accumulator.
Figure 2:
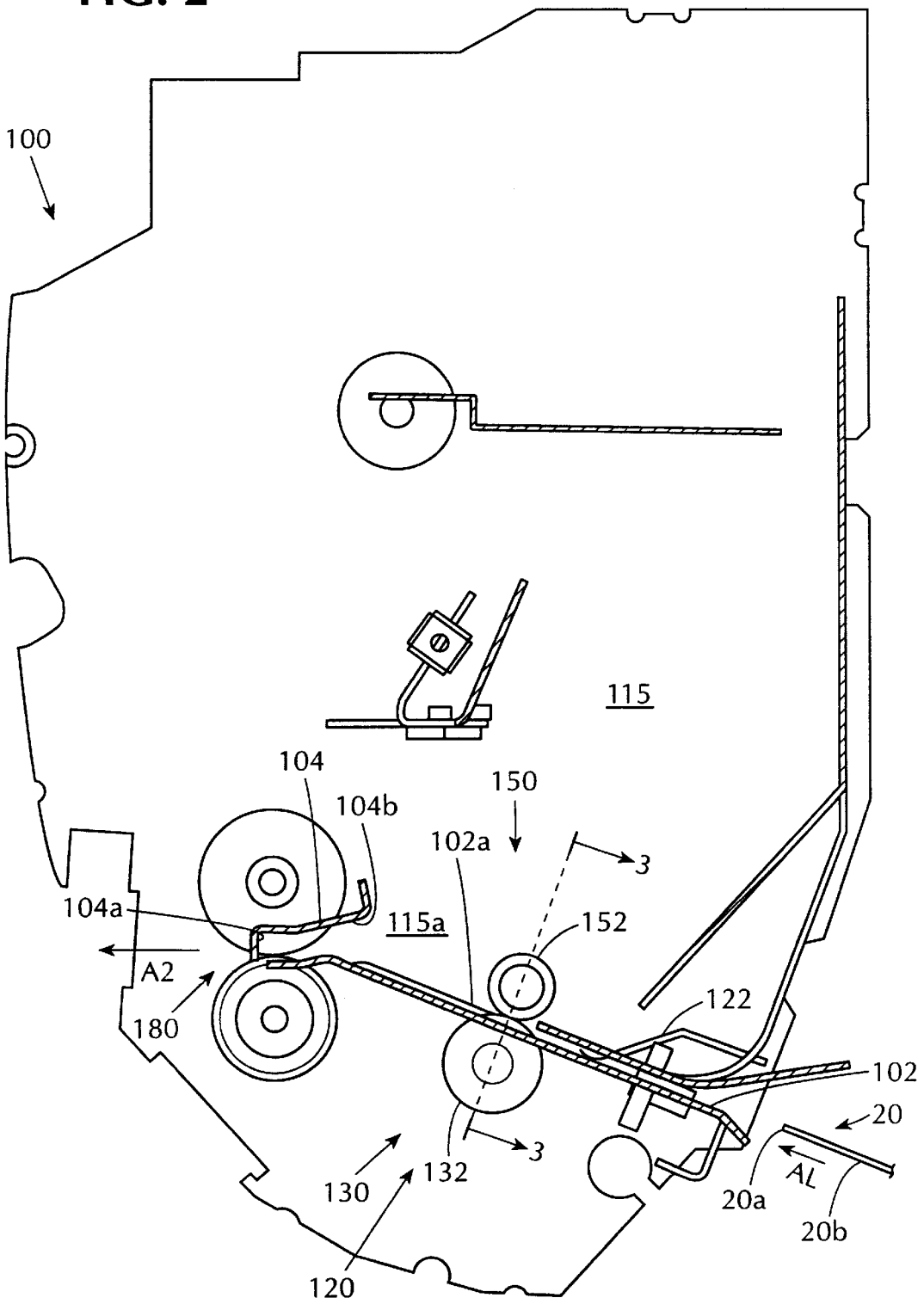
FIG. 2 is a schematic representation of an elevational view of a buckle accumulator in accordance with the present invention.

Referring to FIG. 2, an example of a buckle accumulator 100 in which the present invention may be employed is shown. The buckle accumulator 100 includes an input feed system 120 and an output feed system 180 for feeding a sheet along a deck 102. Generally, the input feed system 120 and the output feed system 180 cooperate along with a selectively actuated stop 104 to accumulate a sheet 20 in a receiving space 115 of the buckle accumulator 100. Generally, the deck 102 forms a feed plane to which the sheet 20 conforms during feeding. After a predetermined number of sheets 20 have been accumulated into a stack (not shown), the stack is feed out of the accumulator 100 by the output feed system 180.

The sheet 20 enters the buckle accumulator 100 from an upstream module (not shown), such as a printer, burster, or the like, and is feed in a first path of travel as indicated by the arrow Al. The input feed system 120 receives the sheet 20 from the upstream module and continues to feed the sheet 20 in the path of travel until a lead edge 20*a* of the sheet 20 encounters the stop 104. In an accumulate position, the stop 104 provides an obstructing surface 104*a* disposed within the first feed path that prevents the sheet 20 from continuing downstream. In an output position (not shown), the obstructing surface 104*a* is removed from the first feed path allowing the sheet 20 or a stack thereof to be fed out of the accumulator 100 by the output feed system 180 in a second feed path as indicated by arrow A2. Together, the first feed path and the second feed path are sometimes commonly referred to as a path of travel.

Preferably, the output feed system 180 is designed to have some degree of slippage with the sheet 20 once the lead edge 20*a* reaches the obstructing surface 104*a*. In this manner, the output feed system 180 may continue to operate with the stop 104 in the accumulate position without further advancing the sheet 20. Alternatively, the output feed system 180 may be provided with a more positive nip and can be selectively operated to feed the sheet 20: (i) until the lead edge 20*a* of each sheet reaches the obstructing surface 104*a*; and (ii) when feeding the stack (not shown) out of the accumulator 100.

To assist the lead edge 20*a* in reaching the output feed system 180, the stop 104 includes a guide portion 104*b* that is angled back toward the receiving space 115. Thus, as the input feed system 120 feeds the sheet 20, the guide portion 104*b* directs the lead edge 20*a* to the output feed system 180. After the lead edge 20*a* reaches the obstructing surface 104*a*, the input feed system 120 continues to feed the sheet 20 causing the sheet 20 to buckle toward the receiving space 115. Still further feeding by the input feed system 120 causes the buckling portion of the sheet 20 to unroll into the receiving space 115 as will be shown further in subsequent Figures. However, as described above, to allow the buckle to form and enter the receiving space 115, the guide portion 104*b* is preferably not too close to the input feed system 120 so that a portion 115*a* of the receiving space 115 located between the input feed system 120 and the output feed system 180 and adjacent the first feed path is substantially unobstructed.

Alternatively, the obstructing surface 104*a* and the guide portion 104*b* may be separate parts. They have been shown together for convenience and ease of assembly. The important consideration is that the portion 115*a* of the receiving space 115 located between the input feed system 120 and the output feed system 180 and adjacent the first feed path should remain substantially unobstructed.

Figure 5:
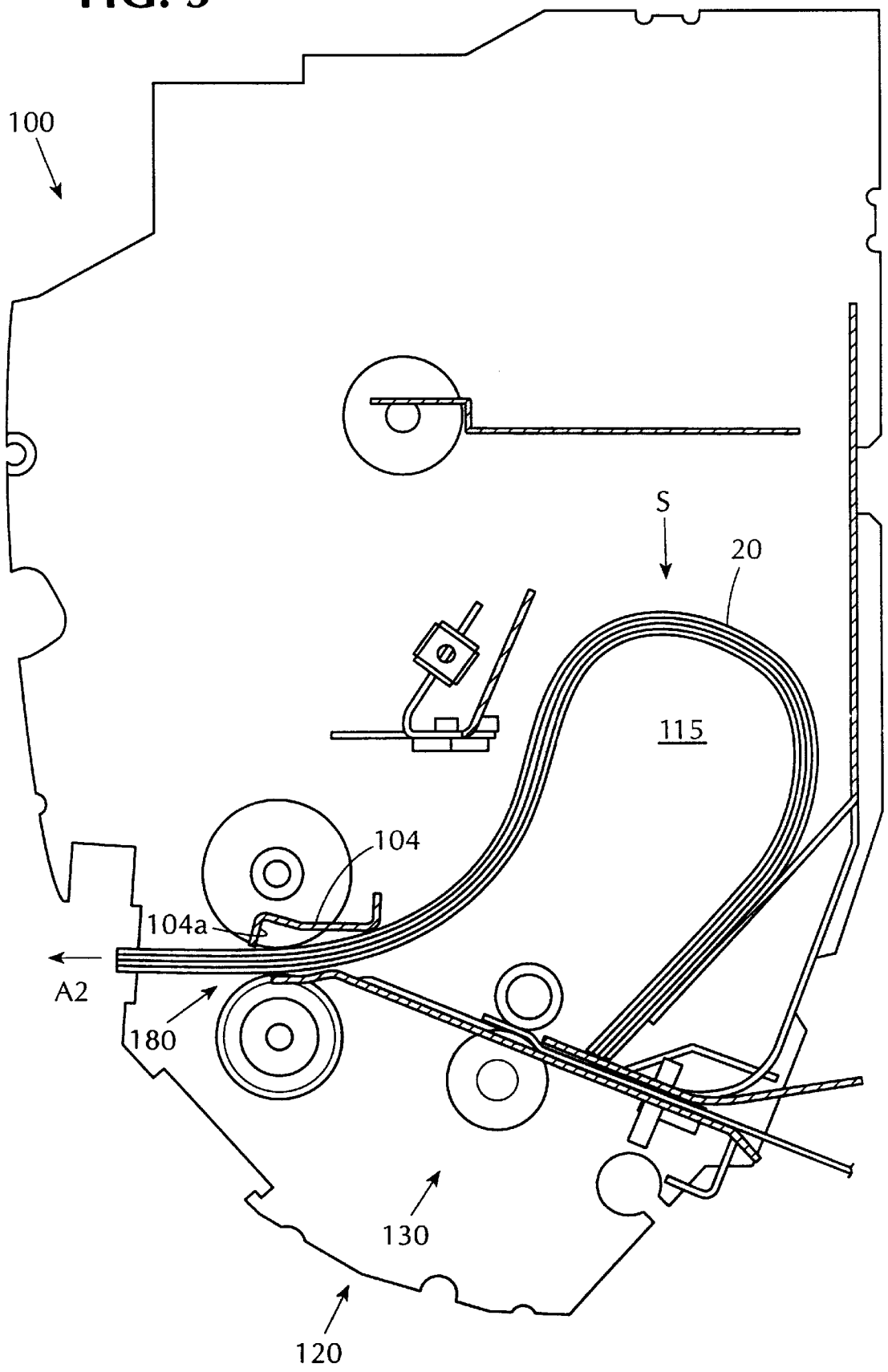
FIG. 5 is a schematic representation of an elevational view of the buckle accumulator showing a stack of sheets being fed from the buckle accumulator in accordance with the present invention.

Referring to FIG. 5, an elevational view of the buckle accumulator 100 showing a stack S of sheets 20 being fed from out of the buckle accumulator 100 in the direction indicated by the arrow A2 is shown. At this point in time, the obstructing surface 104*a* of the stop 104 has been rotated out of the feed path.

Figure 3:
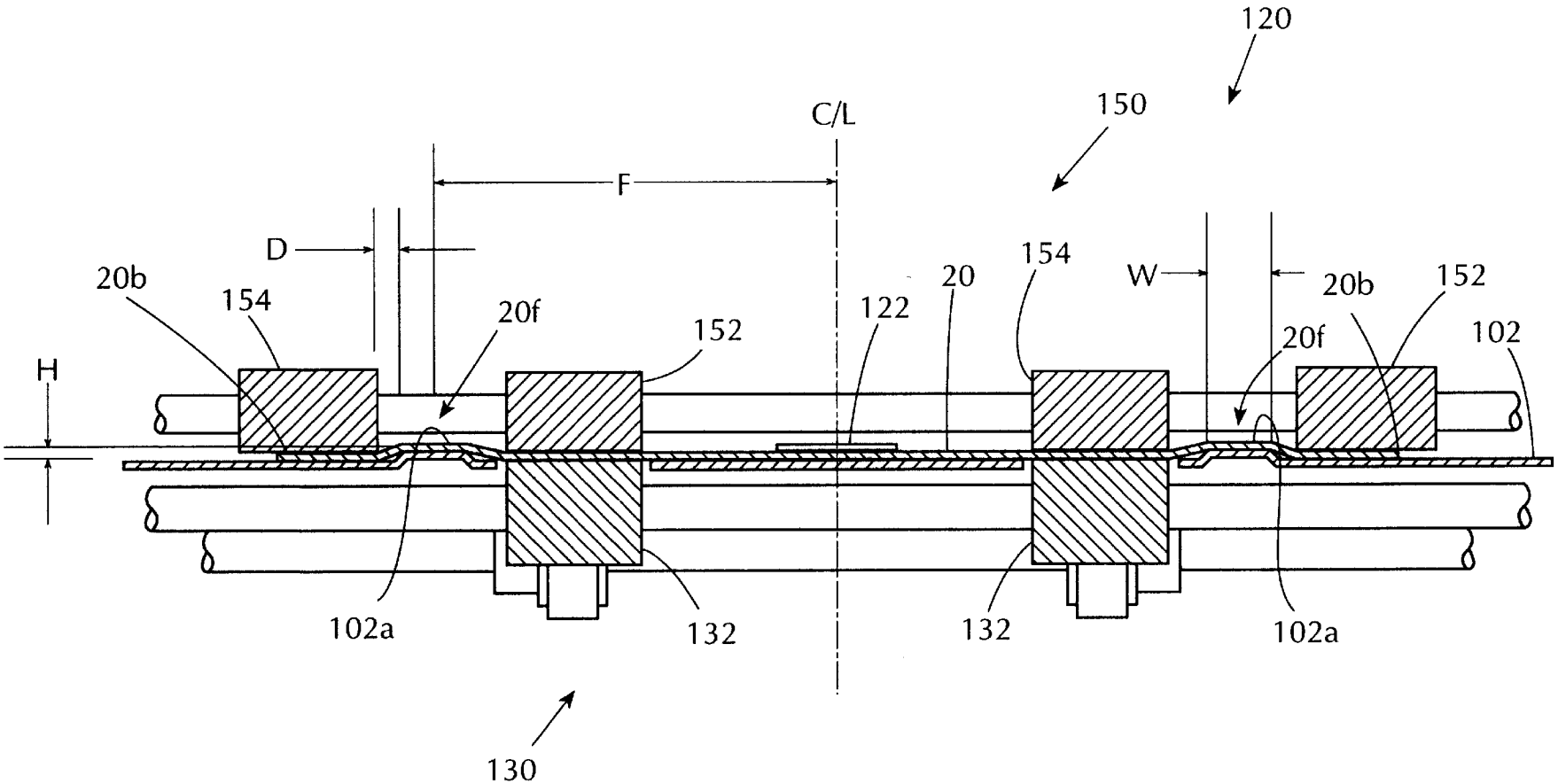
FIG. 3 is a schematic representation of a cross sectional view taken along lines 3—3 as shown in FIG. 2 of an input feed system of the buckle accumulator in accordance with the present invention

Referring to FIG. 3, a schematic representation of a cross sectional view taken along lines 3—3 as shown in FIG. 2 of the input feed system 120 is shown. For the sake of clarity, the nip of the input feed system 120 has been offset from the deck 102 in the elevational views. Generally, FIG. 3 provides a more accurate representation of the relationship of the nip of the input feed system 120 with respect to the deck 102 and the sheet 20. A phantom line C/L represents the center line of the sheet 20 as it is fed along the deck 102.

Figure 6:
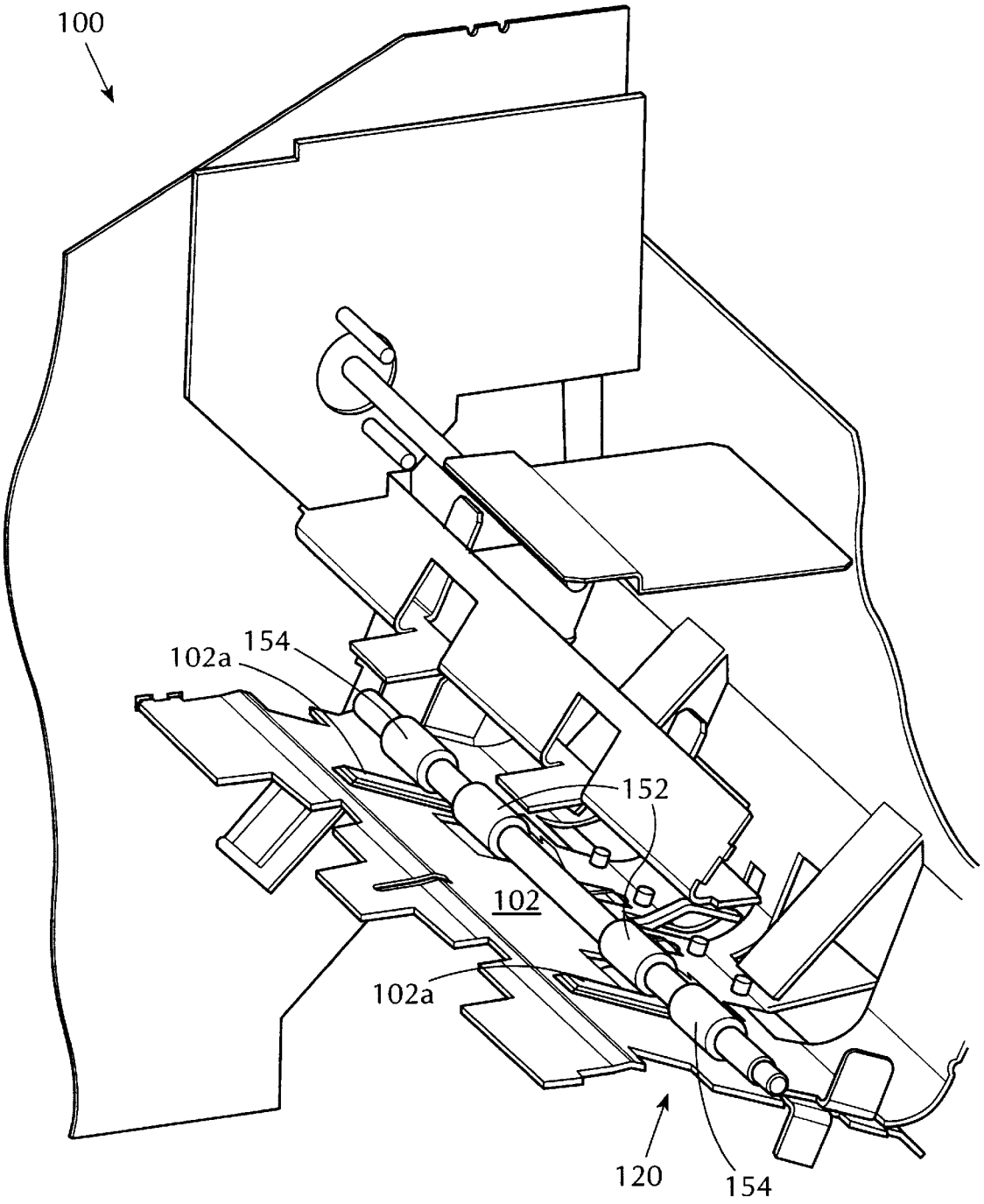
FIG. 6 is a simplified perspective view of the buckle accumulator in accordance with the present invention without any sheets in the receiving space.

Referring to FIGS. 2 and 3 in view of FIG. 6, the input feed system 120 includes a drive system 130, an idler system 150 and a leaf spring 122. The drive system 130 includes a pair of drive rollers 132 that are operatively coupled by any conventional means to a motor (not shown) for causing the drive rollers 132 to rotate. The idler system 150 includes a pair of idler rollers 152 mounted in opposed relationship to the drive rollers 132 to form a nip therebetween. Preferably, the idler rollers 152 are spring biased by any conventional means (not shown) toward the drive rollers 132 so that the sheet 20 remains in intimate contact with the drive rollers 132. The leaf spring 122 is biased toward the deck 102 to assist in keeping the sheet 20 flat against the deck 102 and reduces paper flutter between the drive rollers 132. Generally, the input feed system 120 feeds the sheet 20 along the deck 102 in the first feed path until the lead edge 20 reaches the stop 104.

The idler system 150 further includes a pair of corrugation rollers 154 that are located outboard of the idler rollers 152 and are a positioned to be in alignment with the lateral (side) edges 20*b* of the sheet 20, respectively. Preferably, the corrugation rollers 154 are springIbiased by any conventional means (not shown) toward the deck 102 so that the lateral edges 20*b* of the sheet 20 remain pressed firmly against the deck 102. Located between each respective grouping of the drive roller 132/idler roller 152 and its associated corrugation roller 154 is a corrugation guide 102*a* which, for convenience, is formed from a raised portion of the deck 102. Thus, the corrugation guide 102*a* is raised above the plane of the deck 102. The effect of the corrugation guides 102*a* in cooperation with the drive system 130, the idler system 150 and the deck 102 is to induce furrows 20*f* into the sheet 20.

Figure 4A:
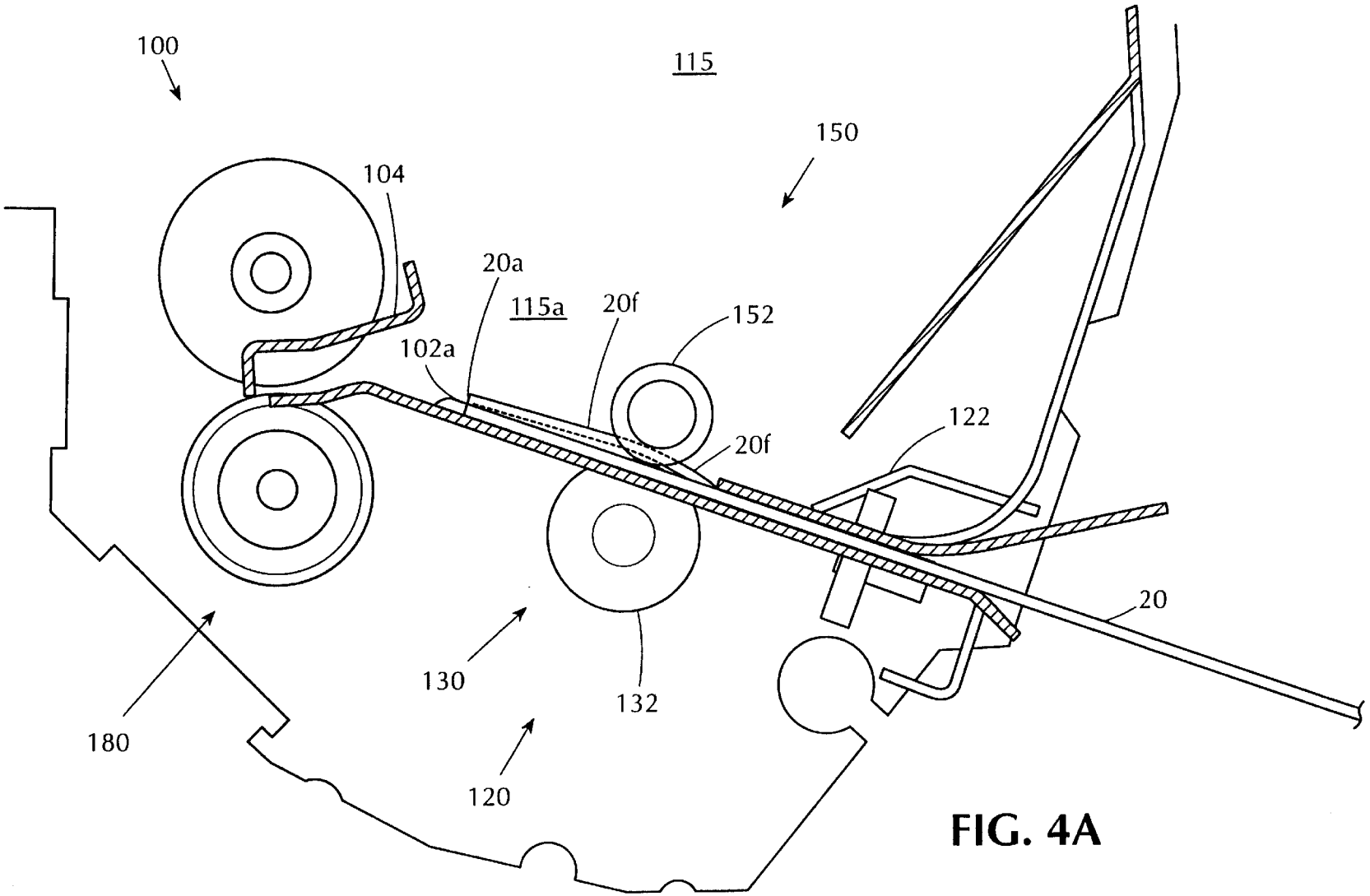
FIG. 4A is a schematic representation of an enlarged elevational view of the buckle accumulator showing a sheet being fed from the input feed system to the output feed system of the buckle accumulator in accordance with the present invention.

Referring to FIG. 4A in view of FIG. 3, an enlarged elevational view of the buckle accumulator 100 showing the sheet 20 being fed from the input feed system 120 to the output feed system 180 is shown. For the sake of facilitating the following discussion, the lead edge 20*a* of the sheet 20 is shown approximately half way between the input feed system 120 and the output feed system 180. The furrows 20*f* are most pronounced at the nip of the input feed system 120 and gradually loose prominence moving away from the nip as the sheet 20 relaxes and resumes its original shape. Generally, the furrows 20*f* run along the sheet 20 in the direction of the first path of travel and increase the stiffness of the sheet 20 by providing increased beam strength. Thus, the sheet 20 is less susceptible to paper curl, vibration, air turbulence, and the like in portion 115*a* of the receiving space 115 located between the input feed system 120 and the output feed system 180.

Another benefit of the furrows 20*f* is that the lead corners of the sheet 20, as defined by the portions of the sheet 20 where the edges 20*b* meet the lead edge 20*a*, are predisposed toward the deck 102. As the sheet 20 emerges from the nip of the input feed system 120, the lead corners dip downward toward the deck 102 due the stresses induced on the sheet 20 by the furrows. Thus, the lead edge 20*a* is directed away from the receiving space 115 and more reliably reaches the nip of the output feed system 180.

Those skilled in the art will recognize still another advantage of the present invention over the prior art. In U.S. Pat. No. 5,356,263, gravity works to pull the lead edge of the sheet away from the nip of the output rollers as the sheet is being fed from the input rollers to the output rollers. This is in contrast to the present invention. Those skilled in the art will appreciate that as the sheet 20 advances along the deck 102 and the effects of the furrows 20*f* begin to dissipate, the lead edge 20*a* will bend downward conforming to the angled portion of the feed deck 102 proximate to the nip of the output fed system 180 in alignment with the second feed path. As a result of all of the above, the lead edge 20*a* more reliably reaches the nip of the output feed system 180.

Figure 4B:
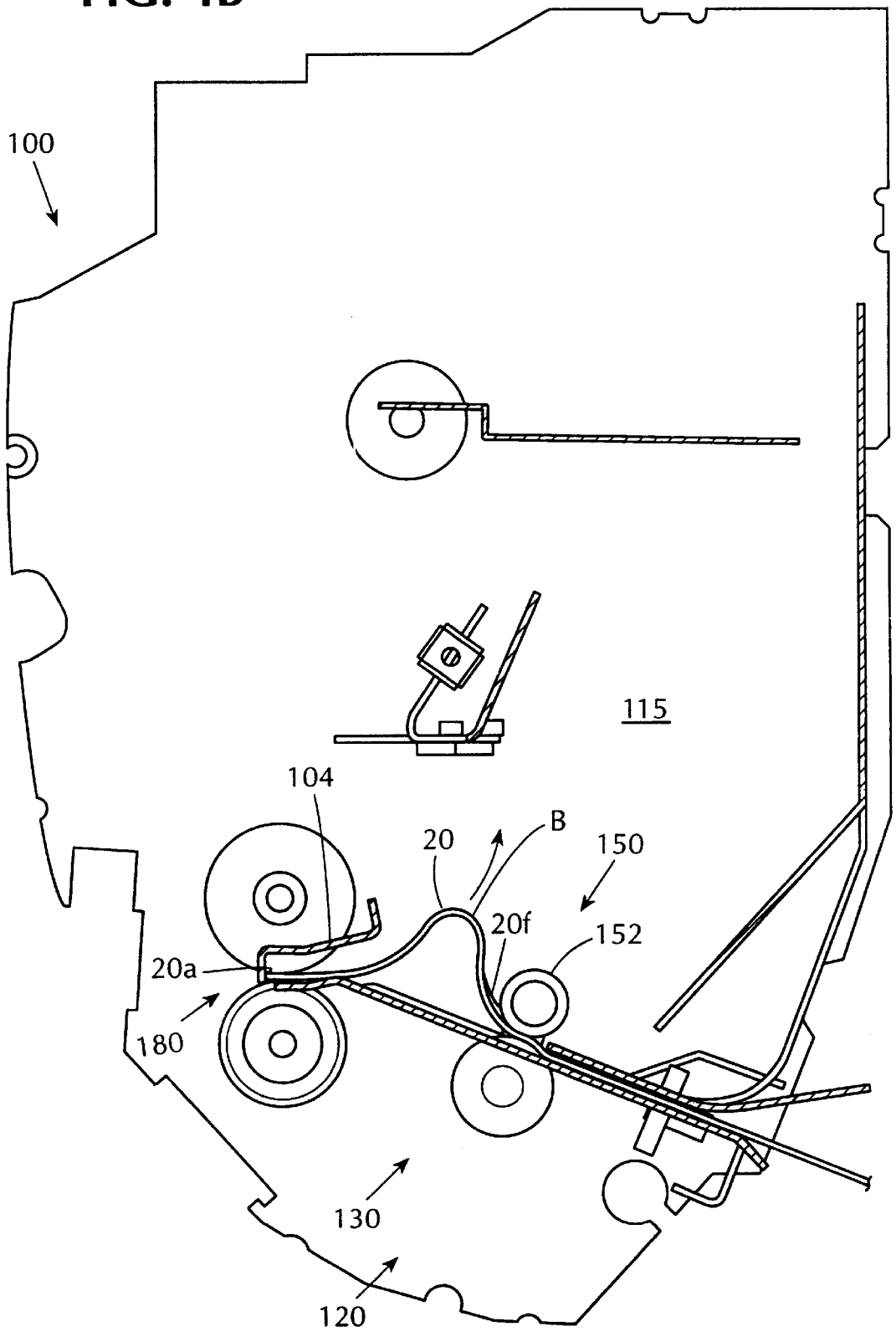
FIG. 4B is a schematic representation of an elevational view of the buckle accumulator showing the sheet being buckled and entering a receiving space of the buckle accumulator in accordance with the present invention.

Referring to FIG. 4B, an elevational view of the buckle accumulator 100 showing the sheet 20 being fed from the input feed system 120 to the output feed system 180 is shown at a point in time after the lead edge 20*a* has reached the stop 104 and a buckle B is beginning to form expanding into the receiving space 115.

Referring to FIGS. 4B and 6, those skilled in the art will appreciate that the furrows 20*f* provide an added benefit at this point in time in respect of a second type of failure mode. Due to the increased stiffness caused by the furrows 20*f*, the sheet 20 is prevented from folding back on itself and becoming wrapped around the corrugation rollers 154 and idler rollers 152. Thus, the buckle B is kept away from the peripheries of the corrugation rollers 154 and idler rollers 152 and the likelihood that the buckle B would be feed through the nip of the input feed system 120 is reduced.

In view of the above description of the structural features of the present invention, the details of the dimensions and geometric relationships of the components of the input feed system 120 will now be described. Referring to FIG. 3, several critical dimensions relating to the shape and configuration of the furrows 20*f*, as well as the location of the furrows 20*f* with respect to the edges 20*b* of the sheet 20, are identified as: guide distance D, guide height H, guide width W and guide offset F. Generally, all of these dimensions are measured in a direction substantially transverse to the first feed path. The guide distance D is defined as the gap between the corrugation guide 102*a* and the beginning of the corrugation roller 154. The guide height H is defined as the distance that the corrugation guide 102*a* raises up from the deck 102. The guide width W is defined as the distance across the corrugation guide 102*a*. The guide offset F is defined as the distance from the phantom line C/L representing the center line of the paper path to the center of the corrugation guide 102*a*.

Generally, the guide distance D, guide height H, guide width W and guide offset F are selected to balance competing interests and practical considerations. For example, it is desirable that the furrows 20*f* leave no permanent effect on the sheet 20. In this way, the input feed system 120 will not distort the sheet 20. Therefore, the furrows 20*f* may not be so pronounced that the sheet 20 does not return to its original shape. As a result, there is a trade-off between beam strength and permanent distortion. As another example, these dimensions are highly influenced by the type of paper stock being employed. For instance, it is desirable that the guide offset F is selected so that the edges 20*b* are controlled by the corrugation rollers 154 meaning that the furrows 20*f* are contained internal to the sheet 20.

Another consideration is that the furrows 20*f* may not be so pronounced that the sheet 20 does not form a proper buckle B having a gradual loop shape. If the sheet 20 is too stiff, then the buckle B does not form properly. In an extreme case, the sheet 20 does not form the buckle B at all. Instead, the sheet 20 simply creases due to the beam strength of the furrows 20*f*. But, as discussed above, it is important that the buckle B is kept away from the peripheries of the corrugation rollers 154 and idler rollers 152. As a result, there is a trade-off between beam strength, proper buckle B formation and reducing the risk of the second type of failure mode.

To optimize these competing interests and practical considerations, empirical testing and "Design of Experiment" (Taguchi) analysis techniques were employed. Table 1 shows the results of six tests that were conducted where the guide distance D, guide height H and guide width W were varied while the guide offset F was held constant because system performance was deemed to be less

TABLE 1

Figure 7A:
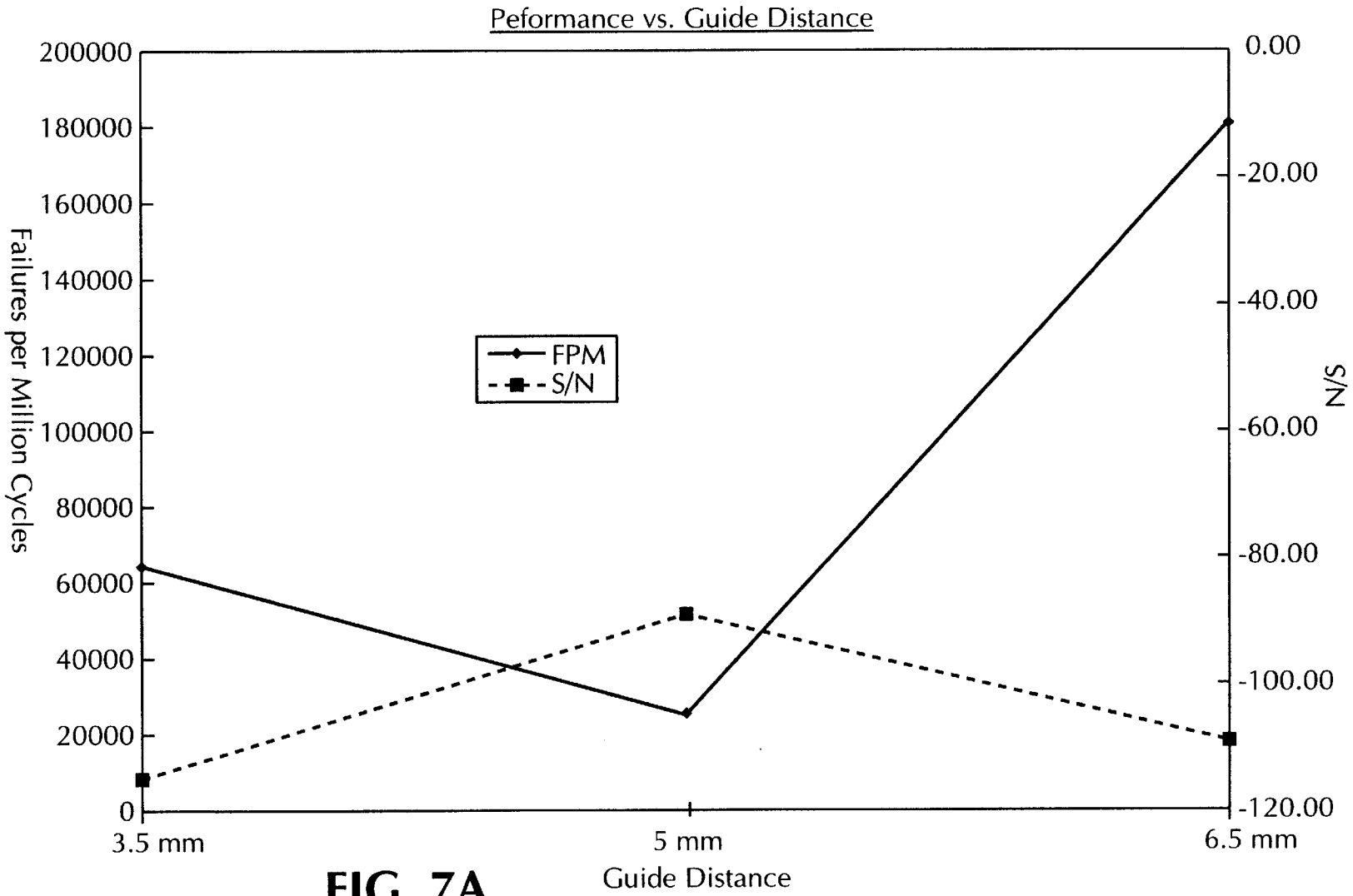
FIG. 7A is a graph of accumulator performance in view of different guide distances in accordance with the present invention.
Figure 7B:
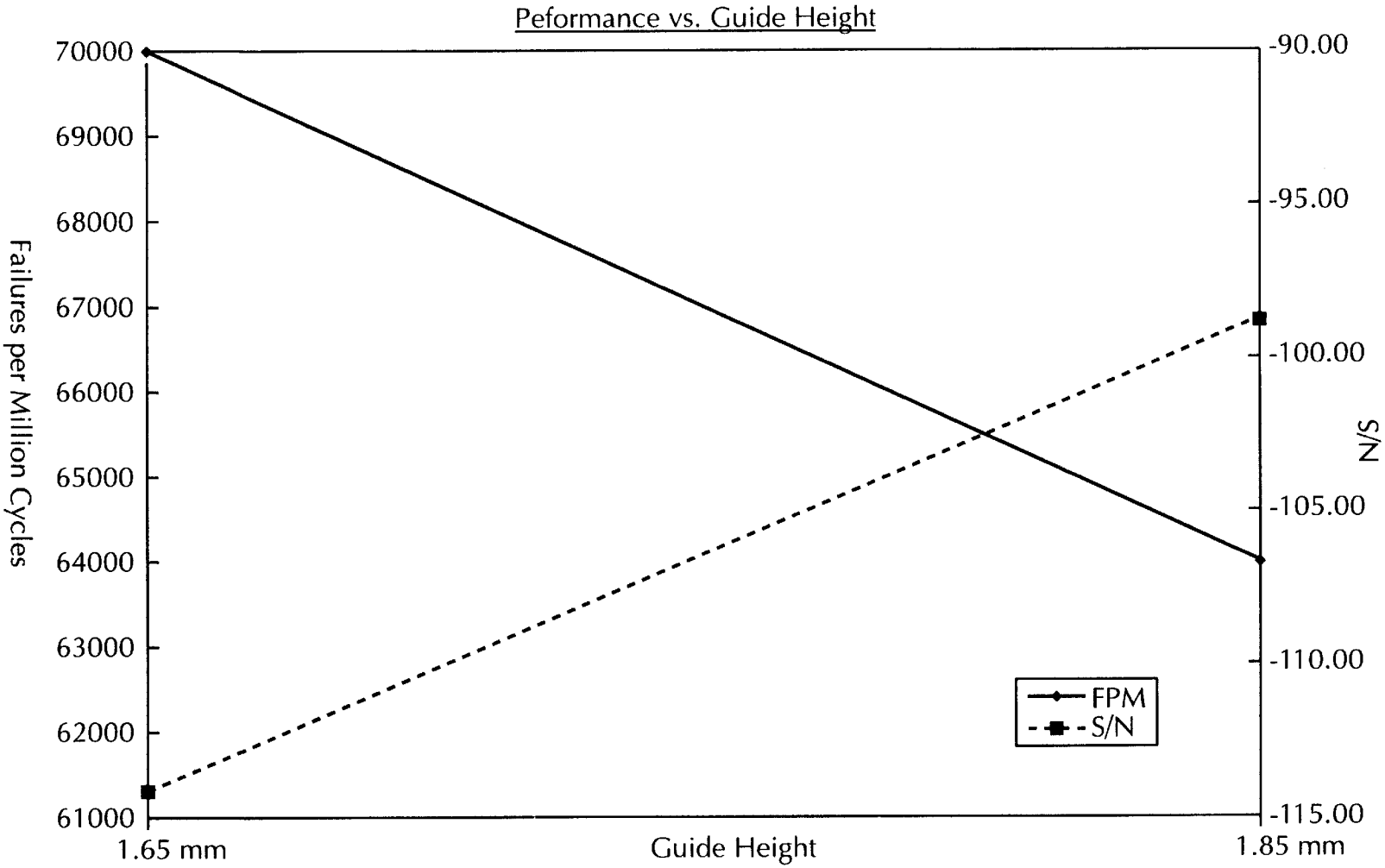
FIG. 7B is a graph of accumulator performance in view of different guide heights in accordance with the present invention.
Figure 7C:
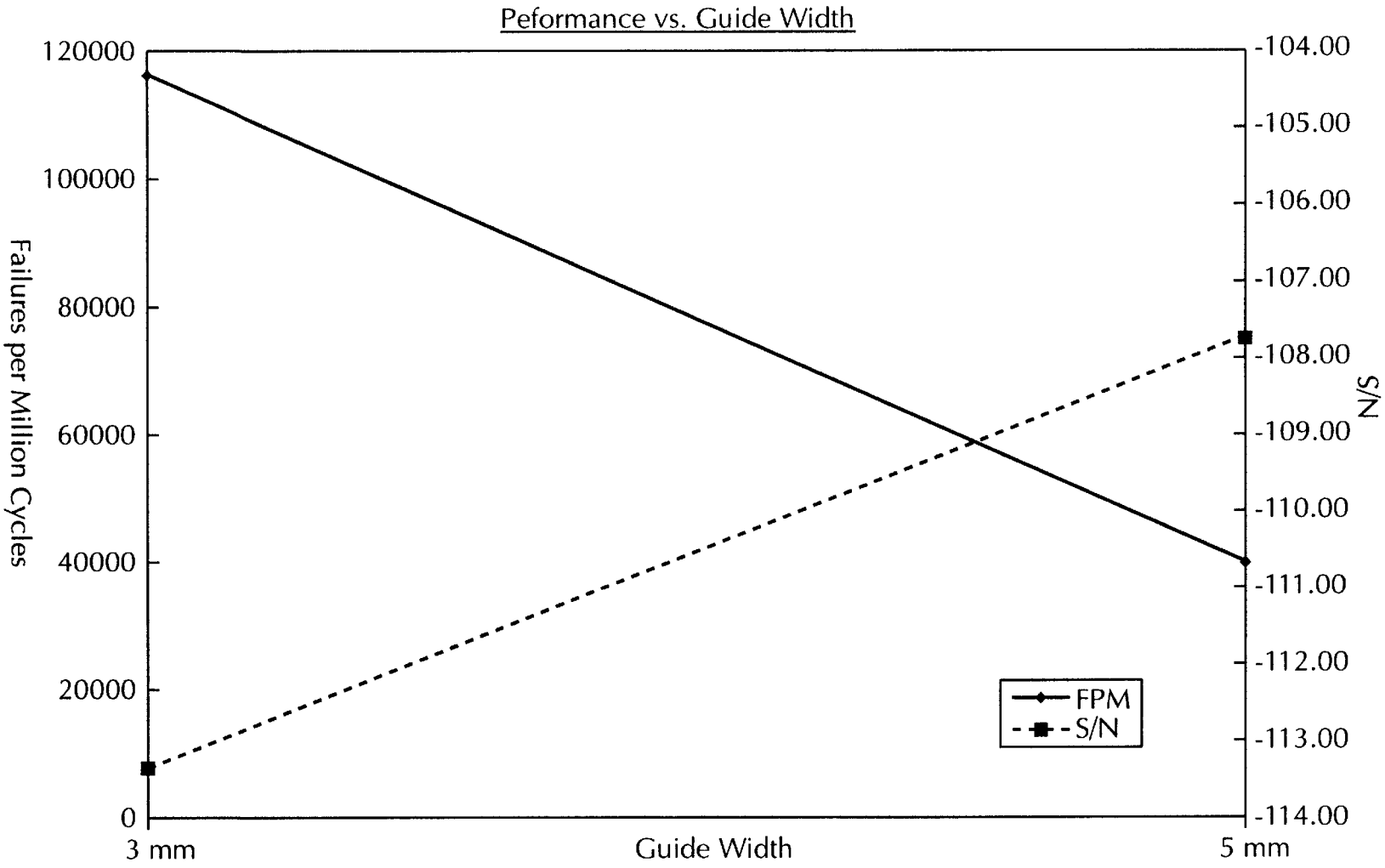
FIG. 7C is a graph of accumulator performance in view of different guide widths in accordance with the present invention.

| Test # | D | H | W | Results |
|---|---|---|---|---|
| | Design of Experiment | | | |
| 1 | 3.5 mm | 1.65 mm | 3.0 mm | 80 faults in 100 cycles |
| 2 | 3.5 mm | 1.85 mm | 5.0 mm | 33 faults in 518 cycles |
| 3 | 5.0 mm | 1.65 mm | 5.0 mm | 35 faults in 1960 cycles |
| 4 | 5.0 mm | 1.85 mm | 3.0 mm | 34 faults in 923 cycles |
| 5 | 6.5 mm | 1.65 mm | 5.0 mm | 35 faults in 84 cycles |
| 6 | 6.5 mm | 1.85 mm | 3.0 mm | 50 faults in 386 cycles |

influenced by the guide offset F. The tests were run on twenty pound paper stock with 8.5 inch by 11 inch (215.9 mm by 279.4 mm) sheets. Generally, each test was run until at least thirty faults were detected. Each test captured the number of faults (paper jams) and the total number of cycles run. Referring to FIGS. 7A, 7B and 7C, performance graphs are shown with respect to each variable dimension where FPM is failures per million cycles and S/N is signal to noise ratio. Using "Design of Experiment" analysis techniques, the optimum performance conditions were found to be a guide distance D of 5.0 mm, a guide height H of 1.85 mm and a guide width W of 5.0 mm.

Further empirical testing in view of the above considerations resulted in subsequent modifications to these dimensions. In the most preferred embodiment, a guide distance D of about 6.14 mm, a guide height H of about 1.80 mm and a guide width W of about 9.13 mm in conjunction with a guide offset F of about 76.80 mm yielded improved performance over earlier configurations without causing any noticeable permanent distortion to the sheet 20.

Many features of the preferred embodiments represent design choices selected to best exploit the inventive concepts with respect to a particular type and size of paper. However, those skilled in the art will recognize that various modifications can be made without departing from the spirit of the present invention to adapt the inventive concepts to other uses.

Therefore, the inventive concepts in their broader aspects are not limited to the specific details of the preferred embodiments but are defined by the appended claims and their equivalents.

What is claimed is:

1. A buckle accumulator, comprising:

a deck;

an input feed system for feeding a sheet along the deck in a path of travel into the buckle accumulator, the sheet having a leading edge and a stiffness;

an output feed system located downstream in the path of travel from the input feed system for feeding the sheet out of the buckle accumulator; and a corrugation guide surface raised above the deck, the corrugation guide surface extending in the path of travel from the input feed system toward the output feed system and terminating before reaching the output feed system, the corrugation guide surface positioned internal to the sheet and away from a lateral edge of the sheet wherein:

the lead edge of the sheet is substantially unrestrained between the input feed system and the output feed system; and as the sheet is feed over the corrugation guide surface by the input feed system, a furrow is imparted within the sheet to increase the stiffness of the sheet between the input feed system and the output feed system and to bias the lead edge of the sheet toward the deck so that the lead edge of the sheet substantially follows the path of travel and enters the output feed system.

2. The buckle accumulator of claim 1, wherein:

the furrow dissipates as the lead edge of the sheet travels further from the input feed system.

3. The buckle accumulator of claim 2, wherein:

the furrow dissipates such that the lead edge of the sheet returns to its original shape before it reaches the output feed system.

4. The buckle accumulator of claim 3, wherein:

the path of travel includes a first feed plane in alignment with an input feed direction of the input feed system and a second feed plane different from the first feed plane in alignment with an output feed direction of the output feed system; and the lead edge of the sheet loses stiffness as it approaches the output feed system so that the lead edge of the sheet begins to conform to the second feed plane.

5. A method of feeding a sheet having a leading edge and a stiffness in a buckle accumulator, comprising the step(s) of:

feeding the sheet along a deck in a path of travel into the buckle accumulator using an input feed system;

feeding the sheet out of the buckle accumulator using an output feed system located downstream in the path of travel from the input feed system;

feeding the sheet over a corrugation guide surface raised above the deck, the corrugation guide surface extending in the path of travel from the input feed system toward the output feed system and terminating before reaching the output feed system, the corrugation guide surface positioned internal to the sheet and away from a lateral edge of the sheet;

leaving the lead edge of the sheet substantially unrestrained between the input feed system and the output feed system; and imparting a furrow within the sheet to increase the stiffness of the sheet between the input feed system and the output feed system and to bias the lead edge of the sheet toward the deck so that the lead edge of the sheet substantially follows the path of travel and enters the output feed system.

6. The method of claim 5, further comprising the step(s) of:

dissipating the furrow as the lead edge of the sheet travels further from the input feed system.

7. The method of claim 6, further comprising the step(s) of:

dissipating the furrow such that the lead edge of the sheet returns to its original shape before the lead edge of the sheet reaches the output feed system.

8. The method of claim 7, further comprising the step(s) of:

feeding the sheet in a first feed plane in alignment with an input feed direction of the input feed system;

feeding the sheet in a second feed plane different from the first feed plane in alignment with an output feed direction of the output feed system; and wherein:

the lead edge of the sheet loses stiffness as it approaches the output feed system so that the lead edge of the sheet begins to conform to the second feed plane.

* * * * *